US011944168B1

(12) United States Patent
Yue

(10) Patent No.: US 11,944,168 B1
(45) Date of Patent: Apr. 2, 2024

(54) WEARABLE MAGNETIC STRAP AND WEARABLE DEVICE

(71) Applicant: Wenyong Yue, Shenzhen (CN)

(72) Inventor: Wenyong Yue, Shenzhen (CN)

( * ) Notice: Subject to any disclaimer, the term of this patent is extended or adjusted under 35 U.S.C. 154(b) by 0 days.

(21) Appl. No.: 18/452,870

(22) Filed: Oct. 9, 2023

(51) Int. Cl.
*A44C 5/00* (2006.01)
*A44C 5/20* (2006.01)

(52) U.S. Cl.
CPC ..... *A44C 5/0053* (2013.01); *A44C 5/2071* (2013.01); *A44D 2203/00* (2013.01)

(58) Field of Classification Search
CPC ..... A44C 5/0053; A44C 5/04; A44C 5/2071; A44B 11/00
See application file for complete search history.

(56) References Cited

U.S. PATENT DOCUMENTS 5,307,582 A * 5/1994 Quintel ..... A42B 1/22 224/267
5,309,575 A * 5/1994 Lookhoof ..... A41F 9/002 2/322
7,398,559 B2 * 7/2008 Flatt ..... A42C 5/02 2/181
8,353,064 B2 * 1/2013 Tagatz ..... A45D 44/08 2/50
8,997,318 B2 * 4/2015 Nicolas ..... A44C 5/2071 24/303
9,420,856 B2 * 8/2016 Proud ..... G06F 1/163
D786,127 S * 5/2017 Akana ..... D11/94
9,826,789 B2 * 11/2017 Dey ..... A44C 27/00
9,894,964 B2 * 2/2018 Perkins ..... G04B 37/1486
9,907,345 B2 * 3/2018 O'Neill ..... A41F 1/002
9,926,953 B2 * 3/2018 Russell-Clarke .. A44B 17/0005
D822,529 S * 7/2018 Akana ..... D11/13
D934,101 S * 10/2021 Akana ..... D11/13
D940,583 S * 1/2022 Akana ..... D11/5
D975,573 S * 1/2023 Cao ..... D11/3
2011/0083254 A1 * 4/2011 Trutna ..... A41F 3/02 2/326
2014/0259545 A1 * 9/2014 King ..... A44B 11/006 29/3
2016/0255944 A1 * 9/2016 Baranski ..... A44C 5/2071
2016/0282899 A1 * 9/2016 Inagaki ..... G06F 1/163
2016/0299526 A1 * 10/2016 Inagaki ..... G06F 3/04883
2018/0020193 A1 * 1/2018 Blum ..... G03B 17/561
2018/0213895 A1 * 8/2018 Green ..... A44C 5/2071
2019/0365061 A1 * 12/2019 Martin ..... G09F 3/005
2022/0100151 A1 * 3/2022 Pandya ..... G04G 17/08
2023/0044185 A1 * 2/2023 Troy ..... H04M 1/04

* cited by examiner

*Primary Examiner* — Brian D Nash
(74) *Attorney, Agent, or Firm* — Daniel M. Cohn; Howard M. Cohn

(57) ABSTRACT

A wearable device and a wearable magnetic strap are disclosed. The wearable device includes a first magnetic strap, a second magnetic strap, and a wearable component. One end of the first magnetic strap is fixed on the wearable component, and one end of the second magnetic strap is fixed on the wearable component. The first magnetic strap and the second magnetic strap are molded from a mixture of plastic and magnetic powder, and the first magnetic strap and the second magnetic strap are gaplessly attached to each other and attracted to each other.

10 Claims, 4 Drawing Sheets

WEARABLE MAGNETIC STRAP AND WEARABLE DEVICE

TECHNICAL FIELD

The present disclosure relates to a technical field of wearable products, and in particular to a wearable magnetic strap and a wearable device.

BACKGROUND

Wearable devices are portable devices directly worn on a user or integrated into clothes or accessories. The wearable devices are not only hardware devices, but also realizing powerful functions through software support, data interaction, and cloud interaction. The wearable devices bring a lot of changes to users' lives and perceptions.

Wearable devices are generally configured as portable accessories with computing functions connected to mobile phones and various terminals. Mainstream wearable devices comprise watch-type wearable devices (e.g., watches, wristbands, etc.) worn on a wrist, shoe-type wearable devices (e.g., shoes, socks, and other wearing products worn on feet) worn on the feet, glasses-type wearable devices (e.g., goggles, helmets, headbands, etc.), as well as various non-mainstream products such as smart clothing, schoolbags, crutches, ornaments, etc.

For wearable devices with straps, in order to facilitate the users to wear, magnetic structures are disposed on straps in the prior art.

The Chinese patent application No. CN201020190570.9 discloses a magnetic wristband. The magnetic wristband comprises a wristband and a magnetic device, and the magnetic device is disposed on the wristband.

The Chinese patent application No. CN202120100322.9 discloses a magnetic silicone wristband. A fixing structure is disposed on an outer surface of the wristband, and the fixing structure comprises a magnetic plate. A surface of the magnetic plate is rotatably connected with the wristband. One end of the wristband away from the magnetic plate defines connecting grooves. The magnetic silicone wristband solves a problem of weakening magnetism after long-term use of magnetic structures.

The Chinese design patent No. CN202330070383.X discloses a magnetic wristband.

However, the wearable devices with straps in the prior art generally need to dispose buckle structures on the straps to realize fixing of the straps of the wearable devices. In practical applications, because thicknesses of wrists of different users are different, sizes of the straps after worn on different wrists vary. However, the straps of the wearable devices in the prior art cannot meet needs of different users.

SUMMARY

The present disclosure provides a wearable magnetic strap and a wearable device to solve defects in the prior art.

Embodiments of the present disclosure provides the wearable device, and the wearable device comprises a first magnetic strap, a second magnetic strap, and a wearable component.

One end of the first magnetic strap is fixed on the wearable component, and one end of the second magnetic strap is fixed on the wearable component.

The first magnetic strap and the second magnetic strap are molded from a mixture of plastic and magnetic powder, and the first magnetic strap and the second magnetic strap are gaplessly attached to each other and attracted to each other.

In one optional embodiment, the first magnetic strap comprises a first fixing portion and a first magnetic portion. The first fixing portion is disposed on the one end of the first magnetic strap. The first fixing portion is fixed to the wearable component. The first magnetic portion is fixedly connected to the first fixing portion.

The second magnetic strap comprises a second fixing portion and a second magnetic portion. The second fixing portion is disposed on the one end of the second magnetic strap. The second fixing portion is fixed to the wearable component. The second magnetic portion is fixedly connected to the second fixing portion.

The first magnetic portion and the second magnetic portion are gaplessly attached to each other and attracted to each other.

In one optional embodiment, a width of the first magnetic portion is equal to a width of the second magnetic portion.

In one optional embodiment, the second magnetic strap further comprises a third magnetic portion. The third magnetic portion and the second magnetic portion are fixedly connected to define a through hole between the second magnetic portion and the third magnetic portion. The second magnetic portion is disposed between the third magnetic portion and the second fixing portion. The through hole allows the first magnetic portion to pass through.

In one optional embodiment, the third magnetic portion and the first magnetic portion are gaplessly attached to each other and attracted to each other.

In one optional embodiment, a width of the first magnetic portion is equal to a width of the second magnetic portion. A width of the third magnetic portion is greater than a width of the first magnetic portion.

In one optional embodiment, the first magnetic strap comprises a first fixing portion and a first magnetic portion, and the first fixing portion is disposed on the one end of the first magnetic strap. The first fixing portion is fixed to the wearable component. The first magnetic portion is fixedly connected to the first fixing portion.

The second magnetic strap comprises a second fixing portion, a second magnetic portion, and a third magnetic portion. The second fixing portion is disposed on the one end of the second magnetic strap. The second fixing portion is fixed to the wearable component. The second magnetic portion is fixedly connected to the second fixing portion. The third magnetic portion is fixedly connected to the second magnetic portion. The second magnetic portion is disposed between the second fixing portion and the third magnetic portion.

The second magnetic strap further comprises a through hole defined by the second magnetic portion and the third magnetic portion. The through hole allows the first magnetic portion to pass through.

A width of the first magnetic portion is equal to a width of the second magnetic portion. Any position of an outer surface of the first magnetic portion and any position of an inner surface of the second magnetic portion are attached to each other and attracted to each other.

An outer surface of the third magnetic portion is attached to and attracted to an inner surface of the first magnetic portion.

In one optional embodiment, a first protective layer is wrapped on an outer surface of the first magnetic strap. A second protective layer is wrapped on an outer surface of the second magnetic strap. The first protective layer and the second protective layer are woven layers made from a woven fabric.

The embodiments of the present disclosure further provide the wearable magnetic strap including a first magnetic strap and a second magnetic strap.

The first magnetic strap and the second magnetic strap are molded from a mixture of plastic and magnetic powder. The first magnetic strap and the second magnetic strap are gaplessly attached to each other and attracted to each other.

In one optional embodiment, the first magnetic strap comprises a first fixing portion and a first magnetic portion. The first fixing portion is disposed on the one end of the first magnetic strap. The first magnetic portion is fixedly connected to the first fixing portion.

The second magnetic strap comprises a second fixing portion and a second magnetic portion. The second fixing portion is disposed on the one end of the second magnetic strap. The second magnetic portion is fixedly connected to the second fixing portion.

The first magnetic portion and the second magnetic portion are gaplessly attached to each other and attracted to each other.

In one optional embodiment, a width of the first magnetic portion is equal to a width of the second magnetic portion.

In one optional embodiment, the second magnetic strap further comprises a third magnetic portion. The third magnetic portion and the second magnetic portion are fixedly connected to define a through hole between the second magnetic portion and the third magnetic portion. The second magnetic portion is disposed between the third magnetic portion and the second fixing portion. The through hole allows the first magnetic portion to pass through.

In one optional embodiment, the third magnetic portion and the first magnetic portion are gaplessly attached to each other and attracted to each other.

In one optional embodiment, a width of the first magnetic portion is equal to a width of the second magnetic portion. A width of the third magnetic portion is greater than a width of the first magnetic portion.

In one optional embodiment, the first magnetic strap comprises a first fixing portion and a first magnetic portion. The first fixing portion is disposed on the one end of the first magnetic strap. The first magnetic portion is fixedly connected to the first fixing portion.

The second magnetic strap comprises a second fixing portion, a second magnetic portion, and a third magnetic portion. The second fixing portion is disposed on the one end of the second magnetic strap. The second magnetic portion is fixedly connected to the second fixing portion. The third magnetic portion is fixedly connected to the second magnetic portion. The second magnetic portion is disposed between the second fixing portion and the third magnetic portion.

The second magnetic strap further comprises a through hole defined by the second magnetic portion and the third magnetic portion. The through hole allows the first magnetic portion to pass through.

A width of the first magnetic portion is equal to a width of the second magnetic portion. Any position of an outer surface of the first magnetic portion and any position of an inner surface of the second magnetic portion are attached to each other and attracted to each other.

An outer surface of the third magnetic portion is attached to and attracted to an inner surface of the first magnetic portion.

In one optional embodiment, a first protective layer is wrapped on an outer surface of the first magnetic strap. A second protective layer is wrapped on an outer surface of the second magnetic strap. The first protective layer and the second protective layer are woven layers made from a woven fabric.

In the embodiments of the present disclosure, the first magnetic strap and the second magnetic strap are molded from the mixture of plastic and magnetic powder, so when in a wearing process, the first magnetic strap is directly attached to and attracted to the second magnetic strap In actual application, in the prior art, a buckle structure, such as a magnetic fastening device, is adopted to fasten two straps of a wristband, while in the embodiments of the present disclosure, the first magnetic strap and the second magnetic strap are directly attached to each other, so the first magnetic strap and the second magnetic strap are freely fixed at any position thereof. Therefore, it not only convenient to fix the first magnetic strap to the second magnetic strap, but also convenient to disassemble the first magnetic strap and the second magnetic strap. In addition, the embodiments of the present disclosure meet requirements of different users for a size of the wearable device or a size of the wearable magnetic strap defined after the first magnetic strap is fixed to the second magnetic strap.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor.

In the drawings.

DETAILED DESCRIPTION

Technical solutions in the embodiments of the present disclosure will be clearly and completely described below in conjunction with the accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

Reference herein to "embodiment" means that a particular feature, structure, or characteristic described in connection with one embodiment may be included in at least one embodiment of the present disclosure. The appearances of the "embodiment" in various positions in the specification are not necessarily referring to the same embodiment, and are not independent or alternative embodiments mutually exclusive of other embodiments. Those skilled in the art explicitly and implicitly understand that the embodiments described herein may be combined with other embodiments.

Figure 1:
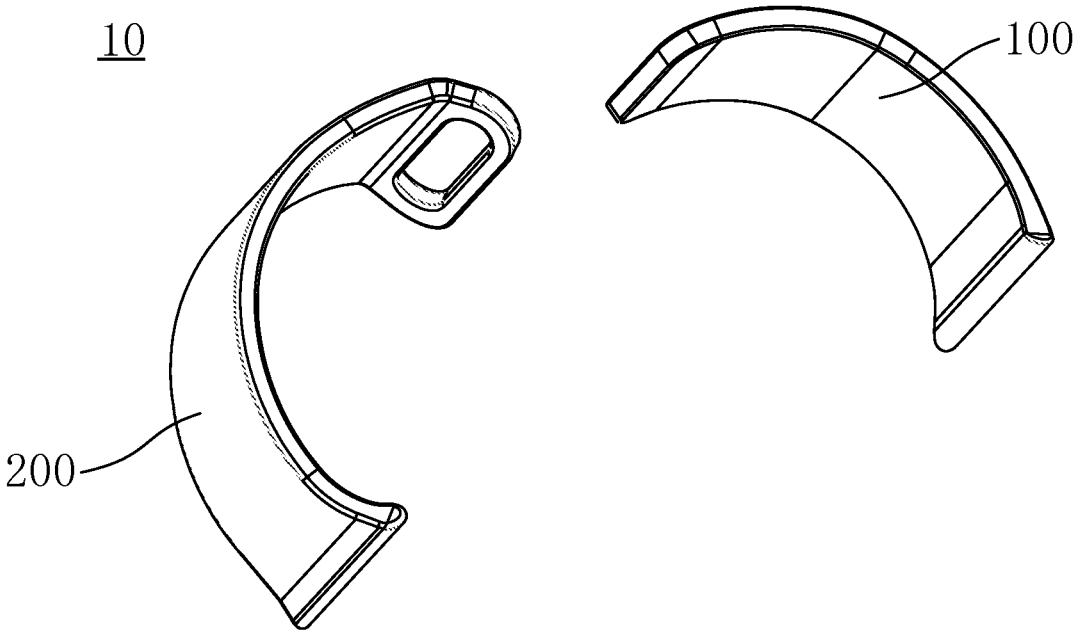
FIG. 1 is a schematic diagram of a wearable magnetic strap according to one embodiment of the present disclosure.
Figure 2:
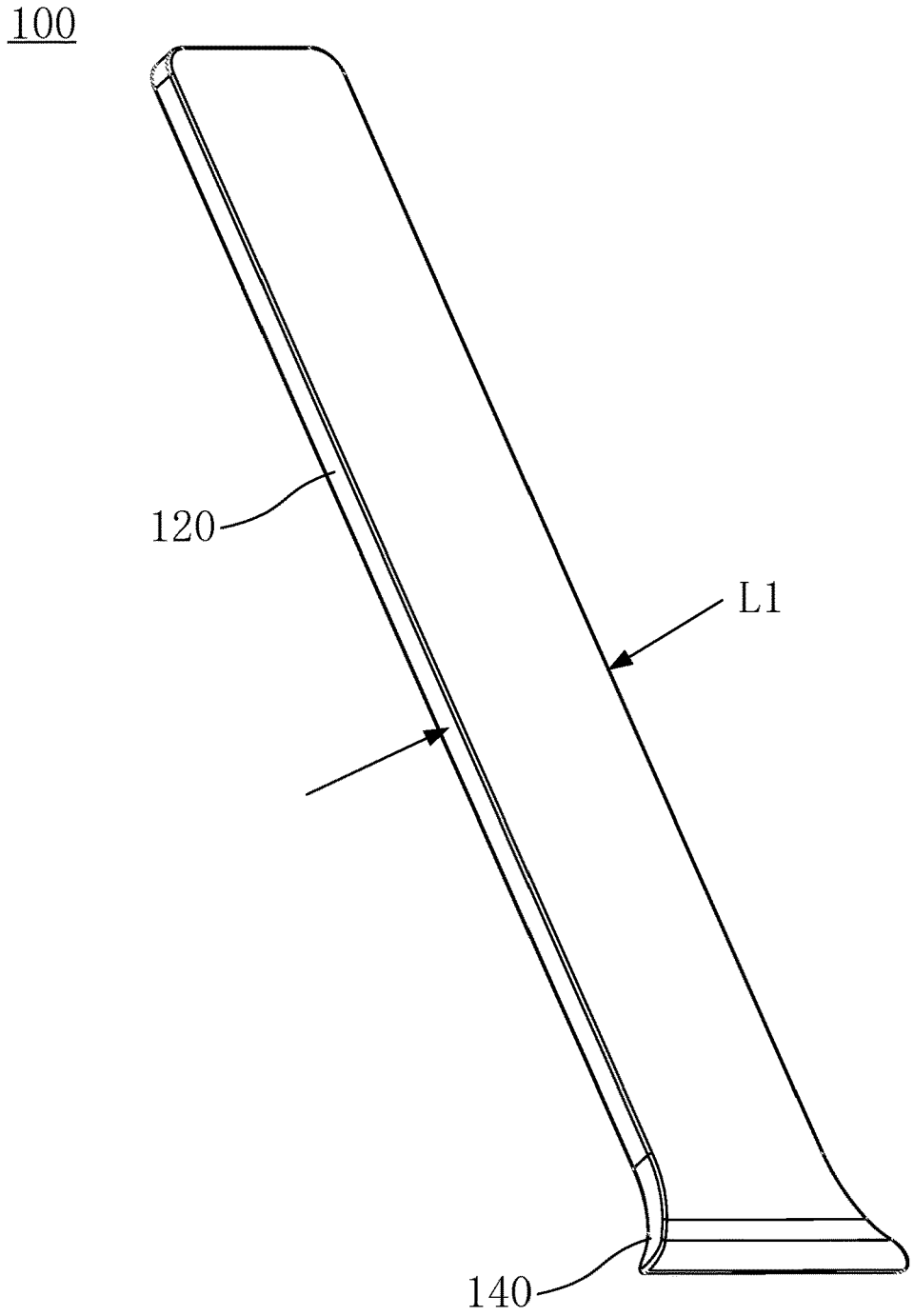
FIG. 2 is a schematic diagram of a first magnetic strap of the wearable magnetic strap according to one embodiment of the present disclosure.
Figure 3:
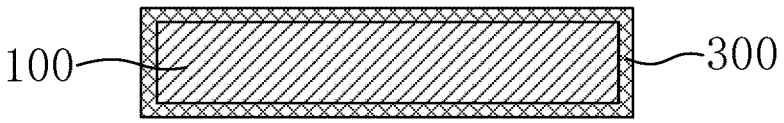
FIG. 3 is a cross-sectional schematic diagram of the first magnetic strap shown in FIG. 2.
Figure 4:
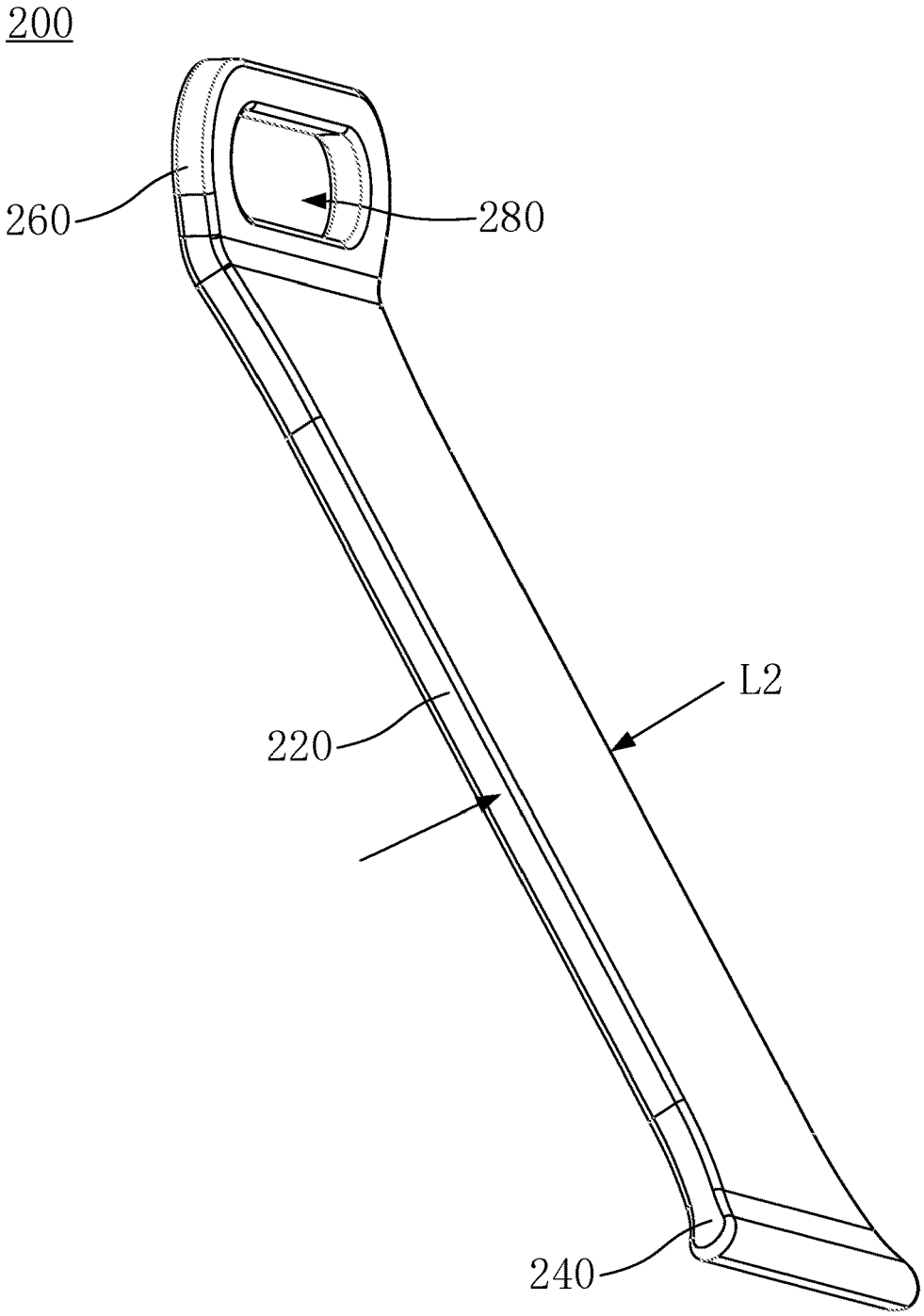
FIG. 4 is a schematic diagram of a second magnetic strap of the wearable magnetic strap according to one embodiment of the present disclosure.
Figure 5:
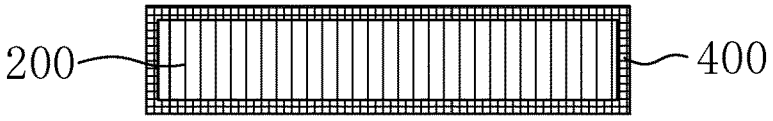
FIG. 5 is a cross-sectional schematic diagram of the second magnetic strap shown in FIG. 4.

As shown in FIGS. 1-5, FIG. 1 is a schematic diagram of a wearable magnetic strap according to one embodiment of the present disclosure, FIG. 2 is a schematic diagram of a first magnetic strap of the wearable magnetic strap according to one embodiment of the present disclosure, FIG. 3 is a cross-sectional schematic diagram of the first magnetic strap shown in FIG. 2, FIG. 4 is a schematic diagram of a second magnetic strap of the wearable magnetic strap according to one embodiment of the present disclosure, and FIG. 5 is a cross-sectional schematic diagram of the second magnetic strap shown in FIG. 4.

The wearable magnetic strap 10 comprises a first magnetic strap 100 and a second magnetic strap 200. The first magnetic strap 100 and the second magnetic strap 200 are molded from a mixture of plastic and magnetic powder. The first magnetic strap 100 and the second magnetic strap 200 are gaplessly attached to each other and attracted to each other. Therefore, it not only convenient to fix the first magnetic strap 100 to the second magnetic strap 200, but also convenient to disassemble the first magnetic strap 100 and the second magnetic strap 200. In addition, the embodiments of the present disclosure meets requirements of different users for a size of the wearable magnetic strap defined after the first magnetic strap 100 is fixed to the second magnetic strap 200.

As shown in FIG. 2, the first magnetic strap 100 comprises a first fixing portion 140 and a first magnetic portion 120. The first fixing portion 140 is disposed on the one end of the first magnetic strap 100. The first magnetic portion 120 is fixedly connected to the first fixing portion 140. In one optional embodiment of the present disclosure, the first magnetic portion 120 and the first fixing portion 140 are integrally disposed. For example, a first mold is configured for injection molding to form the first magnetic portion 120 and the first fixing portion 140.

As shown in FIG. 4, the second magnetic strap 200 comprises a second fixing portion 240 and a second magnetic portion 220. The second fixing portion 240 is disposed on the one end of the second magnetic strap 200. The second magnetic portion 220 is fixedly connected to the second fixing portion 240. In one optional embodiment of the present disclosure, the second magnetic portion 220 and the second fixing portion 240 are integrally disposed. For example, a second mold is configured for injection molding to form the second magnetic portion 220 and the second fixing portion 240.

In one optional embodiment, a width of the first magnetic portion 120 is equal to a width of the second magnetic portion 220. Specifically, the width of the first magnetic portion 120 is defined as L1 as shown in FIG. 2, and the width of the second magnetic portion 220 is defined as L2 as shown in FIG. 4. In the embodiment, L1 =L2.

In one optional embodiment, a thickness of the first magnetic portion 120 is equal to a thickness of the second magnetic portion 220.

In one optional embodiment, the second magnetic strap 200 further comprises a third magnetic portion 260. The third magnetic portion 260 and the second magnetic portion 220 are fixedly connected to define a through hole 280 between the second magnetic portion 220 and the third magnetic portion 260. The second magnetic portion 220 is disposed between the third magnetic portion 260 and the second fixing portion 240. The through hole 280 allows the first magnetic portion 120 to pass through.

It is understood that a width of the third magnetic portion 260 is greater than the width of the first magnetic portion 120. The width of the third magnetic portion 260 is slightly greater than the width of the second magnetic portion 220, so that the first magnetic portion 120 is allowed to normally pass through the through hole 280.

In one optional embodiment, after the first magnetic portion 120 passes through the through hole 280, a portion of the first magnetic portion 120 passing through the through hole 280 is gaplessly attached to the second magnetic portion 220. Another portion of the first magnetic portion 120 cooperates with the third magnetic portion 260, and the third magnetic portion 260 and the first magnetic portion 120 are also attached to each other and attracted to each other.

It should be noted that in one optional embodiment, any position of an outer surface of the first magnetic portion 120 and any position of an inner surface of the second magnetic portion 220 are attached to each other and attracted to each other, so that a position of the first magnetic strap 100 is adjustable on the second magnetic strap 200 is adjustable, enabling the wearable magnetic strap to be matched with arms of different people. In the prior art, two straps of a wristband are connected by other connecting structures, for example, holes are defined on a first strap, and a hook for hooking one of the holes is disposed on a second strap. Compared with the prior are, in the present disclosure, the position of the first magnetic strap 100 is accurately adjusted on the second magnetic strap 200, an adjusting accuracy thereof is much greater than an adjusting accuracy of the two straps in the prior art, thereby meeting requirements of different users and matching with a size of a wearing position.

As shown in FIGS. 3-5, a first protective layer 300 is wrapped on an outer surface of the first magnetic strap 100. A second protective layer 400 is wrapped on an outer surface of the second magnetic strap 200. The first protective layer 300 and the second protective layer 400 are woven layers made from a woven fabric.

Figure 6:
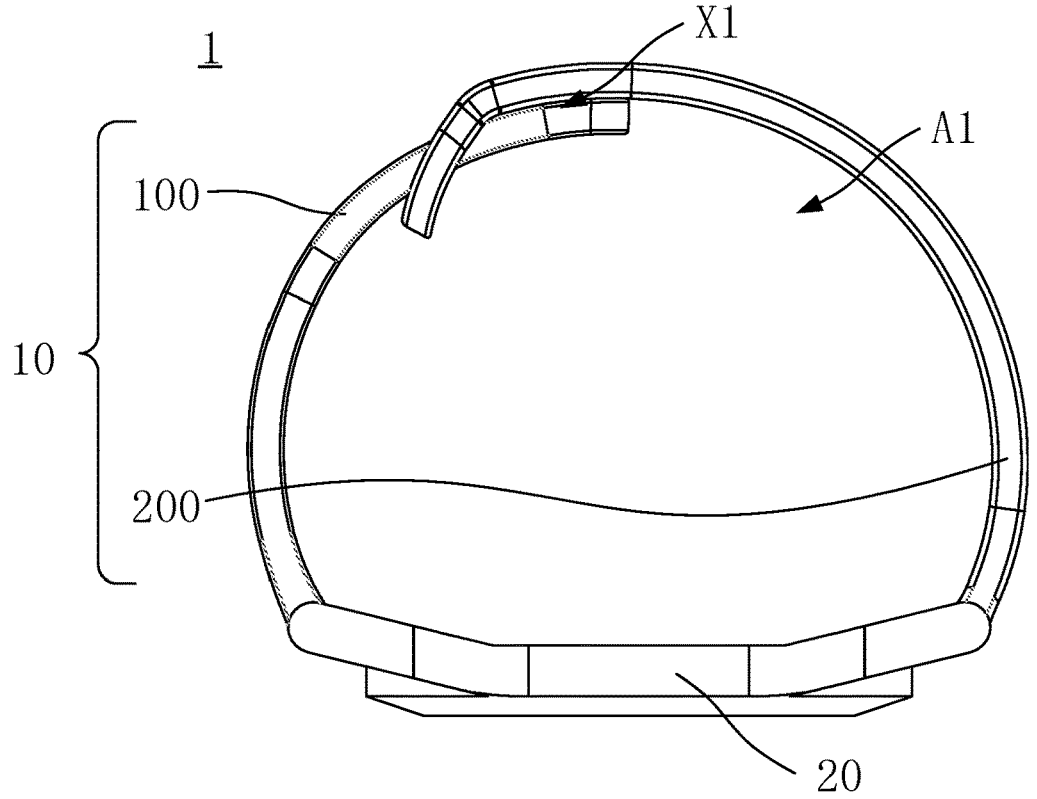
FIG. 6 is a schematic diagram of a wearable device shown in a first use position according to one embodiment of the present disclosure.
Figure 7:
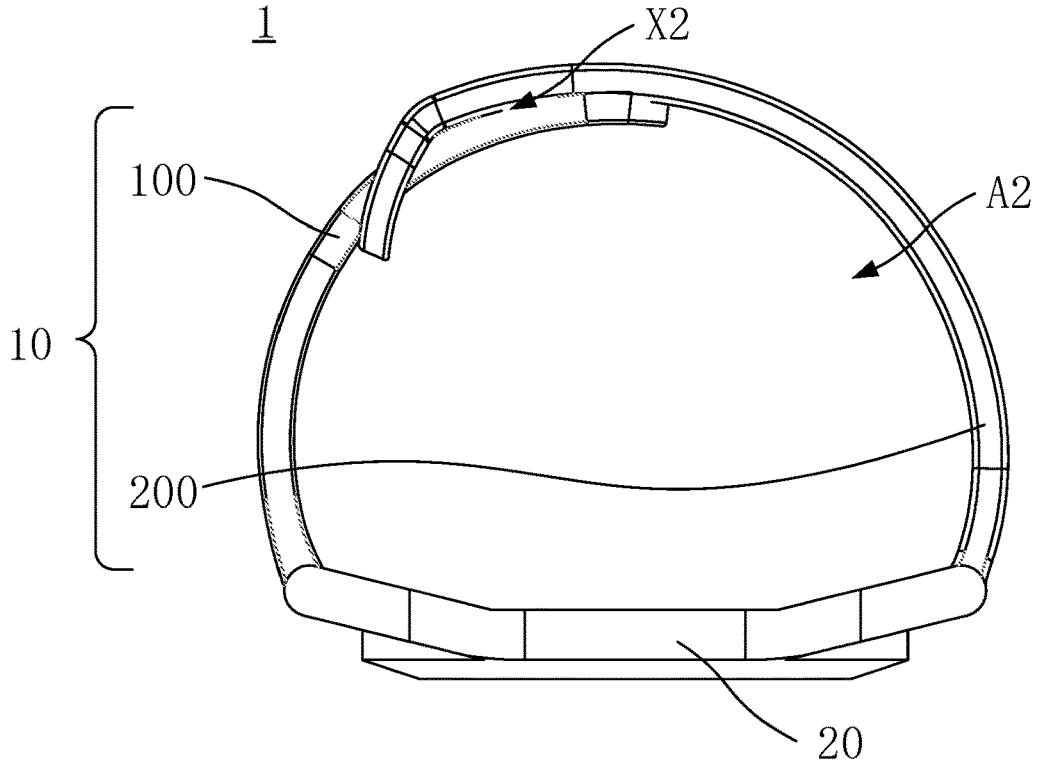
FIG. 7 is a schematic diagram of the wearable device shown in a second use position according to one embodiment of the present disclosure.

As shown in FIGS. 6 and 7, FIG. 6 is a schematic diagram of a wearable device shown in a first use position according to one embodiment of the present disclosure, and FIG. 7 is a schematic diagram of the wearable device shown in a second use position according to one embodiment of the present disclosure. The wearable device comprises the wearable magnetic strap 10 and a wearable component 20 fixedly connected to the wearable magnetic strap 10.

The wearable magnetic strap 10 comprises the first magnetic strap 100 and the second magnetic strap 200. Structures of the first magnetic strap 100 and the second magnetic strap 200 can be referred to FIGS. 1-5 and related content above, and details thereof are not repeated therein.

The one end of the first magnetic strap 100 is fixed on the wearable component 20, and the one end of the second magnetic strap 200 is fixed on the wearable component 20.

Specifically, the first magnetic strap 100 comprises the first fixing portion 140 and the first magnetic portion 120, the first fixing portion 140 is disposed on the one end of the first magnetic strap 100, and the first fixing portion 140 is fixed on the wearable component 20. The second magnetic strap 200 comprises a second fixing portion 240 and a second magnetic portion 220, the second fixing portion 240 is disposed on the one end of the second magnetic strap 200, and the second fixing portion 240 is fixed on the wearable component 20. The second fixing portion 240 and the first fixing portion 140 are respectively disposed on two opposite ends of the wearable component 20.

In one optional embodiment of the present disclosure, the first fixing portion 140 and the wearable component 20 are fixedly connected by a first rotating shaft. The second fixing portion 240 and the wearable component 20 are fixedly connected by a second rotating shaft. It should be noted that the first fixing portion 140 and the wearable component 20 may also be detachably fixed, and the second fixing portion 240 and the wearable component 20 may also be detachably fixed.

The first magnetic portion 120 of the first magnetic strap 100 is attached to the second magnetic portion 220 of the second magnetic strap 200 to define an attaching portion. Specifically, as shown in FIG. 6, the first magnetic portion 120 of the first magnetic strap 100 and the second magnetic portion 220 of the second magnetic strap 200 are attached to each other to define a first attaching portion X1. As shown in FIG. 7, the first magnetic portion 120 of the first magnetic strap 100 and the second magnetic portion 220 of the second magnetic strap 200 are attached to each other to define a second attaching portion X2. Portions of the first magnetic portion 120 and the second magnetic portion 220 within the second attaching portion X2 are greater than portions of the first magnetic portion 120 and the second magnetic portion 220 within the first attaching portion X1. Therefore, it is understood that a wearing space formed by the first magnetic strap 100, the second magnetic strap 200, and the wearable component 20 is changeable. For example, a wearing space A1 formed by the first magnetic strap 100, the second magnetic strap 200, and the wearable component 20 shown in FIG. 6 is greater than a wearing space A2 formed by the first magnetic strap 100, the second magnetic strap 200, and the wearable component 20 shown in FIG. 7.

Therefore, any position of the first magnetic strap 100 is allowed to be attached to and attracted to any position of the second magnetic portion 220, so the portion of the first magnetic strap 100 attached to the second magnetic portion 220 is accurately adjusted. That is, the attaching portion defined by attaching the first magnetic strap 100 to the second magnetic is accurately adjusted, so as to accurately adjust the wearing space formed by the first magnetic strap 100, the second magnetic strap 200, and the wearable component 20.

The above are descriptions of structures of the wearable device and the wearable magnetic strap according to the embodiments of the present disclosure. It should be noted that, in other embodiments, the first magnetic strap and the second magnetic strap are directly and gaplessly attached to each other and without proving the through hole.

What is claimed is:

1. A wearable device, comprising:

a first magnetic strap, a second magnetic strap, and a wearable component;

wherein one end of the first magnetic strap is fixed on the wearable component, and one end of the second magnetic strap is fixed on the wearable component;

wherein the first magnetic strap and the second magnetic strap are molded from a mixture of plastic and magnetic powder, and the first magnetic strap and the second magnetic strap are gaplessly attached to each other and attracted to each other;

the first magnetic strap comprises a first fixing portion and a first magnetic portion; the first fixing portion is disposed on the one end of the first magnetic strap; the first fixing portion is fixed to the wearable component the first magnetic portion is fixedly connected to the first fixing portion;

wherein the second magnetic strap comprises a second fixing portion and a second magnetic portion; the second fixing portion is disposed on the one end of the second magnetic strap; the second fixing portion is fixed to the wearable component the second magnetic portion is fixedly connected to the second fixing portion;

wherein the first magnetic portion and the second magnetic portion are gaplessly attached to each other and attracted to each other;

wherein the second magnetic strap further comprises a third magnetic portion; the third magnetic portion and the second magnetic portion are fixedly connected to define a through hole between the second magnetic portion and the third magnetic portion; the second magnetic portion is disposed between the third magnetic portion and the second fixing portion; the through hole allows the first magnetic portion to pass through.

2. The wearable device according to claim 1, wherein a width of the first magnetic portion is equal to a width of the second magnetic portion.

3. The wearable device according to claim 1, wherein the third magnetic portion and the first magnetic portion are gaplessly attached to each other and attracted to each other.

4. The wearable device according to claim 1, wherein a first protective layer is wrapped on an outer surface of the first magnetic strap; a second protective layer is wrapped on an outer surface of the second magnetic strap; the first protective layer and the second protective layer are woven layers made from a woven fabric.

5. A wearable magnetic strap, comprising: a first magnetic strap and a second magnetic strap;

wherein the first magnetic strap and the second magnetic strap are molded from a mixture of plastic and magnetic powder; the first magnetic strap and the second magnetic strap are gaplessly attached to each other and attracted to each other;

the first magnetic strap comprises a first fixing portion and a first magnetic portion; the first fixing portion is disposed on the one end of the first magnetic strap; the first magnetic portion is fixedly connected to the first fixing portion;

wherein the second magnetic strap comprises a second fixing portion and a second magnetic portion; the second fixing portion is disposed on the one end of the second magnetic strap; the second magnetic portion is fixedly connected to the second fixing portion;

wherein the first magnetic portion and the second magnetic portion are gaplessly attached to each other and attracted to each other;

wherein the second magnetic strap further comprises a third magnetic portion; the third magnetic portion and the second magnetic portion are fixedly connected to define a through hole between the second magnetic portion and the third magnetic portion; the second magnetic portion is disposed between the third magnetic portion and the second fixing portion; the through hole allows the first magnetic portion to Pass through.

6. The wearable magnetic strap according to claim 5, wherein a width of the first magnetic portion is equal to a width of the second magnetic portion.

7. The wearable magnetic strap according to claim 5, wherein the third magnetic portion and the first magnetic portion are gaplessly attached to each other and attracted to each other.

8. The wearable magnetic strap according to claim 7, wherein a width of the first magnetic portion is equal to a width of the second magnetic portion; a width of the third magnetic portion is greater than a width of the first magnetic portion.

9. The wearable magnetic strap according to claim 5, wherein a first protective layer is wrapped on an outer surface of the first magnetic strap; a second protective layer is wrapped on an outer surface of the second magnetic strap; the first protective layer and the second protective layer are woven layers made from a woven fabric.

10. A wearable device, comprising:

a first magnetic strap, a second magnetic strap, and a wearable component;

wherein one end of the first magnetic strap is fixed on the wearable component, and one end of the second magnetic strap is fixed on the wearable component;

wherein the first magnetic strap and the second magnetic strap are molded from a mixture of plastic and magnetic powder, and the first magnetic strap and the second magnetic strap are gaplessly attached to each other and attracted to each other;

wherein a first protective layer is wrapped on an outer surface of the first magnetic strap; a second protective layer is wrapped on an outer surface of the second magnetic strap; the first protective layer and the second protective layer are woven layers made from a woven fabric.

* * * * *